United States Patent [19]

Howell et al.

[11] Patent Number: 4,833,743

[45] Date of Patent: May 30, 1989

[54] BED SAFETY SIDE RAIL

[75] Inventors: William R. Howell, Chaffee; Eric T. Shuler, Orchard Park, both of N.Y.

[73] Assignee: The Quaker Oats Company, Chicago, Ill.

[21] Appl. No.: 232,490

[22] Filed: Aug. 15, 1988

[51] Int. Cl.[4] ..... A47C 21/08

[52] U.S. Cl. ..... 5/426; 5/430; 403/61; 403/101

[58] Field of Search ..... 5/426, 428–430; 403/61, 101

[56] References Cited

U.S. PATENT DOCUMENTS

| | | | |
|---|---|---|---|
| 229,834 | 7/1880 | McMann | 5/430 |
| 1,039,986 | 10/1912 | Merritt | 403/61 |
| 1,041,147 | 10/1912 | Murphy | 403/61 |
| 2,666,217 | 1/1954 | Stuart | 5/430 |
| 4,178,645 | 12/1979 | Cosme | 5/426 |

*Primary Examiner*—Gary L. Smith
*Assistant Examiner*—Michael F. Trettel
*Attorney, Agent, or Firm*—Cumpston & Shaw

[57] ABSTRACT

A safety side rail for a bed is disclosed comprising a side panel supported by a pair of spaced-apart foot members, each adapted to be inserted under a side edge of the bed mattress. The side panel is supported by one end of the foot members, and is movable relative to the foot members via a coupling between a safe-closed position, in which the side panel is fixedly held in a position above the mattress for blocking or preventing a child from falling off the mattress, and an open position, in which the side panel is positioned below the top of the mattress allowing access to the child.

2 Claims, 2 Drawing Sheets

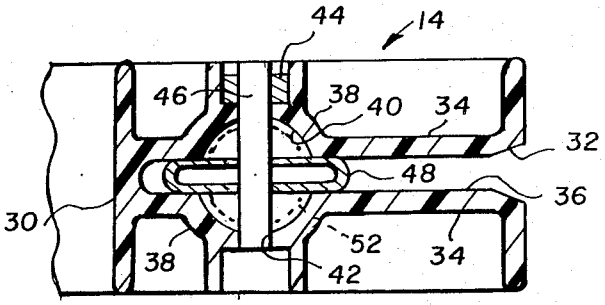
FIG. 3
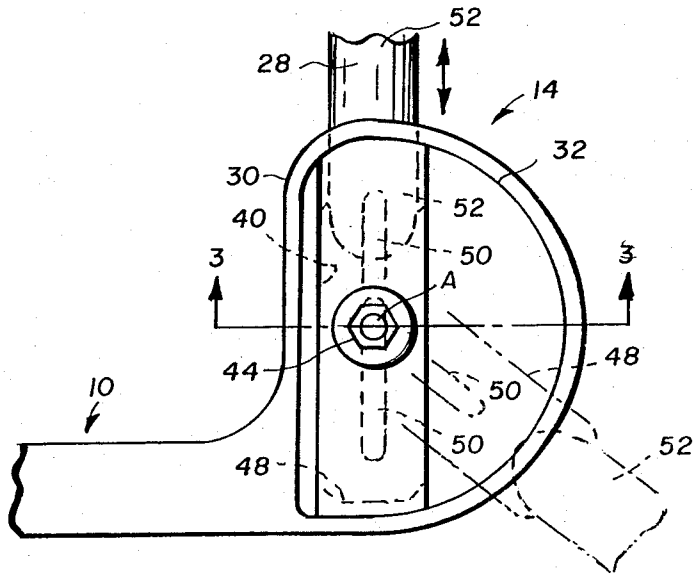
FIG. 2
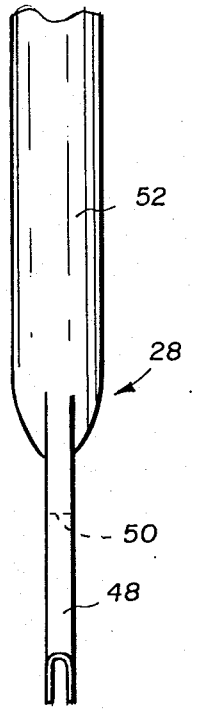
FIG. 5
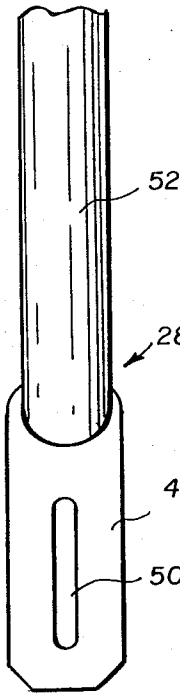
FIG. 4
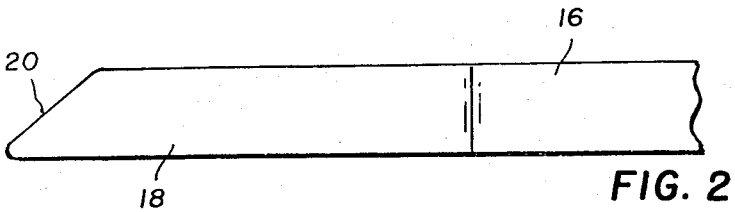

BED SAFETY SIDE RAIL

BACKGROUND OF THE INVENTION

1. Field of the Invention

The present invention relates generally to safety devices, and more particularly to a safety side rail for a bed or the like to prevent a child from falling off the bed, yet allowing ready access to the child when desired.

2. Description of the Prior Art

Safety side rails for beds or the like are well-known in the art. A known safety side rail means comprises a pair of spaced-apart foot members adapted to be placed under a side edge of a mattress, and a side panel secured to the foot member for preventing a child from falling off the mattress. When the safety side rail is no longer needed, the foot members are withdrawn from the mattress and pivoted inwardly into substantial alignment with the side panel for storage. A disadvantage of this known type of safety side rail is that it is difficult for an adult to reach over the safety side rail when it is mounted on the bed to lift the baby out of the bed to or change the baby's diaper. A need exists for a safety side rail having a panel which can be readily moved from a safe-closed position for blocking or preventing a child from falling off a bed, and an open position allowing ready access to the child, even though the safety side rail is still mounted on the bed.

SUMMARY OF THE INVENTION

An object of the present invention is to provide a safety side rail for a bed comprising a pair of spaced-apart foot members adapted to be placed under a side edge of a mattress. The safety side rail further comprises a side panel extending along substantially the full length of the mattress and movable between a safe-closed position, in which the side panel is fixed and held in a position above the top of the mattress for blocking or preventing a child from falling off the mattress, and an open position, in which the side panel is positioned below the top of the mattress allowing access to the child. Socket means are provided coupling the foot members to the side panel for controlling movement of the side rail means between the safe-closed position and open position.

In a more specific aspect of the invention, the socket means comprises a socket having a cylindrical opening extending at least partially therethrough and a flat passageway perpendicular to and merging with the cylindrical opening. The side panel comprises a tube for each socket having a flat end portion and an adjacent cylindrical portion. The cylindrical portion on each tube is slidably mountable into and out of the complementary cylindrical opening in the socket. Slidable movement of the cylindrical portions into the cylindrical openings holds the side panel in a safe-closed position, and slidable movement of the cylindrical portions out of the cylindrical openings allows movement of the side panel to an open position.

BRIEF DESCRIPTION OF THE DRAWINGS

The invention will be described with respect to the drawings, wherein:

FIG. 2 is an enlarged side-elevational view of the foot member of the safety side rail of FIG. 1;

FIG. 3 is a section view taken substantially along line 3—3 of FIG. 2;

FIG. 4 is a fragmentary enlarged side elevational view of one end portion of the tube extending from the side panel; and FIG. 5 is a front elevational view of the tube end portion of FIG. 4.

DETAILED DESCRIPTION OF THE PREFERRED EMBODIMENT

Figure 1:
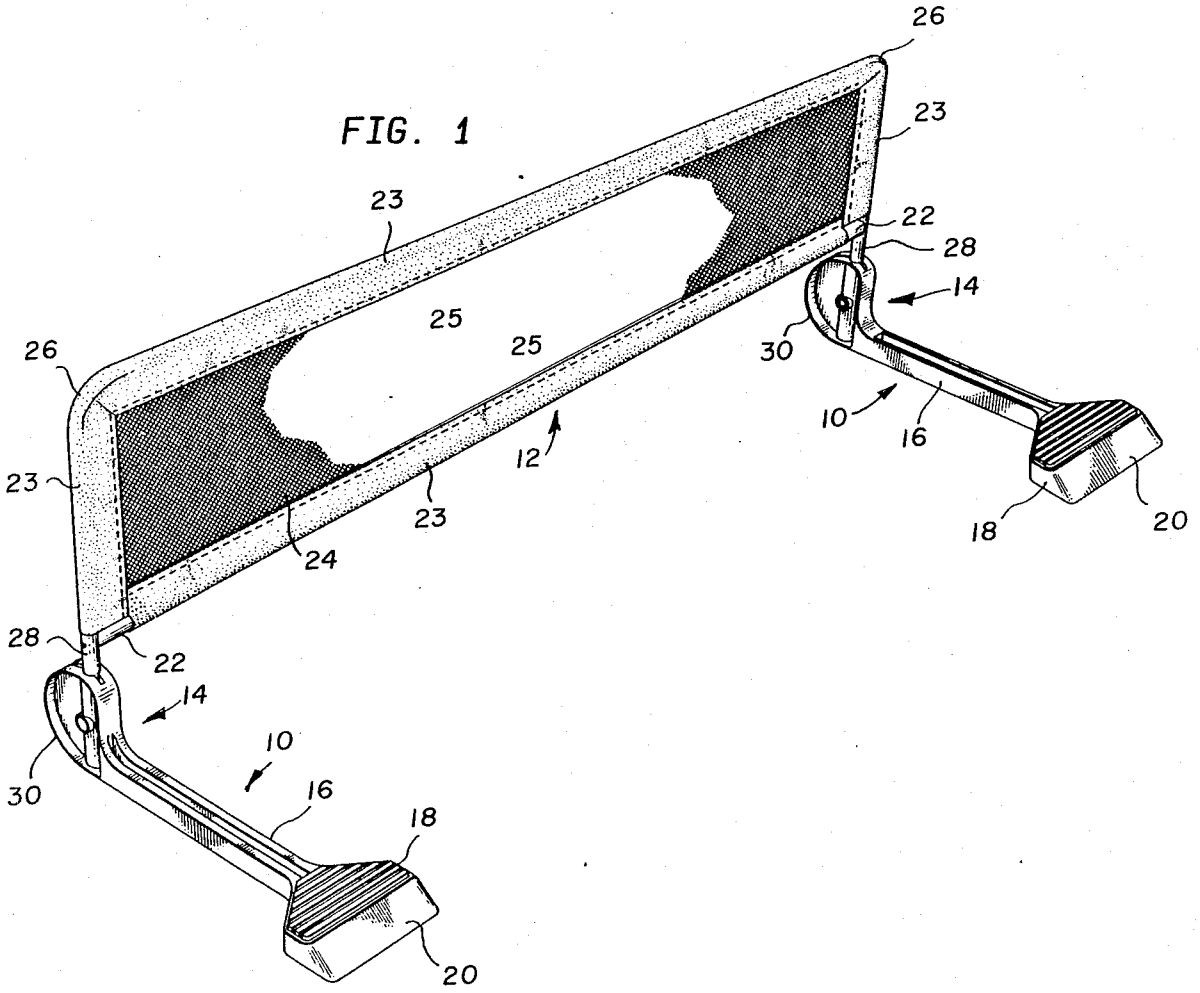
FIG. 1 is a perspective view of the safety side rail in accordance with the present invention.

Because safety side rails for beds are well-known, the present description will be directed in particular to elements forming part of, or cooperating directly with, a safety side rail in accordance with the present invention. It is to be understood that elements not specifically shown and described may take various forms well-known to those skilled in the art.

Referring to FIG. 1, a safety side rail in accordance with the present invention comprises a pair of foot members 10 adapted to be placed under a side edge of a mattress, not shown. A side panel 12 is provided extending along substantially the full length of a mattress and movable between a safe-closed position, in which side panel 12 is fixed and extends above the top of the mattress for blocking or preventing a child from falling off the mattress, and an open position 180° therefrom in which the side panel 12 extends below the mattress for allowing access to the child. Socket means 14 are provided coupling foot members 10 to side panel 12 for controlling movement of the side panel between the safe-closed and open positions.

With reference to FIGS. 1 and 2, since each of the foot members 10 are identical, only one of such foot members will be described in detail. The foot member 10 comprises a central bar portion 16 having a flat foot 18 at one end thereof. The foot has a sharp edge portion 20 to facilitate movement of the member 10 under a mattress. The foot member has socket means 14 at the opposite end thereof.

Referring again to FIG. 1, the safety side panel 12 essentially comprises a rectangular tubular frame 22, only a part of which is shown, covered by any suitable fabric material 24 having side edges 23 bent around the frame and sewed by a thread 25 to the fabric material. Each end tube of frame 22 is curved at 26 and has a straight end portion 28 for insertion into socket means 14.

Referring to FIGS. 2 and 3, the socket means 14 comprises a housing 30 having a semi-circular grooved periphery 32. The housing 30 has a pair of opposed walls 34 (FIG. 3) spaced apart to form a flat passageway 36. Each of the walls 36 further forms a substantially semi-cylindrical wall portion 38 for defining therebetween a cylindrical opening 40 merging with flat passageway 36. Along a central axis A of semi-circular periphery 32, an aperture 42 is provided extending through the semi-cylindrical wall portions 38, as best seen in FIG. 3, for receiving a nut 44 and bolt 46 for a purpose to be explained later.

Referring to FIGS. 4 and 5, the straight end portion 28 of each tube 26 is shown comprising a flat end portion 48 having an elongated slot 50 extending therethrough. Each tube has an adjacent cylindrical portion 52 of a diameter slightly less than the diameter of cylindrical opening 40 in socket 14 so that cylindrical portion 52 can be inserted into cylindrical opening 40.

Referring again to FIG. 2, the two free tube end portions 28 are slid into cylindrical openings 40 in sockets 14 and each are secured thereto for slidable movement by the aforementioned nut 44 and bolt 46 extending through aperture 42, socket wall portion 38 and elongated slot 50. With each tube end portion 28 in the lower-most dotted position shown in FIG. 2, cylindrical portions 52 of tube end portions 28 extend into cylindrical openings 40 to prevent any pivotal movement of side panel 12 relative to socket 14 and foot member 10. This places the side panel in its fixed safe-closed position. However, when tube end portions 28 are slidably moved upwardly into the uppermost dotted position shown in FIG. 2, cylindrical portions 52 are clear of cylindrical openings 40, and side panel 12 is free to be pivotally moved about bolts 46 with cylindrical portions 52 sliding along the peripheries 32 of the semi-circular socket housings 30, as shown in phantom in FIG. 2, to an open position, in which side panel 12 is displaced 180° from the initial safe-closed position.

The invention has been described in detail with particular reference to a preferred embodiment thereof, but it will be understood that variations and modifications can be effected within the spirit and scope of the invention.

What is claimed is:

1. A safety side rail for a bed having a mattress comprising:

a pair of spaced-apart foot members, each adapted to have one end thereof placed under a side edge of a mattress;

a side panel extending along substantially the full length of the mattress comprising a pair of tubes, each tube having a flat end portion and an adjacent cylindrical portion, and movable between a safe-closed position, in which the side panel is fixed for preventing a child from falling off the mattress, and an open position allowing access to the child; and socket means comprising a socket for each tube having a cylindrical opening extending at least partially therethrough, first and second spaced apart semi-circular opposed flat walls forming a semi-circular flat passageway perpendicular to and merging with the cylindrical opening, and an aperture perpendicular to the cylindrical opening and passageway, each flat passageway extending substantially through said socket means, each said passageway adapted to receive a complementary flat end portion of each tube, and each cylindrical opening adapted to receive the cylindrical portion on each tube for coupling the foot members to the side panel for controlling movement of the side panel between a safe-closed position and an opposite open position.

2. A safety side rail according to claim 1 wherein each flat end portion has an elongated slot in alignment with the aperture, and a bolt extends through the aperture, elongated slot and cylindrical opening whereby slidable movement of the cylindrical portions into the cylindrical openings holds the side panel in its safe-closed position, and slidable movement of the cylindrical portion out of the cylindrical opening allows movement of the side panel to its open position.

* * * * *